US005993087A

United States Patent [19]

Katada et al.

[11] Patent Number: 5,993,087

[45] Date of Patent: Nov. 30, 1999

[54] METHOD OF FORMING IMAGE ON ROLL OF PAPER SHEET

[75] Inventors: Masahito Katada; Shuichi Morio; Shigenori Suematsu; Yutaka Shoji; Hiroshi Takahagi, all of Hitachinaka, Japan

[73] Assignee: Hitachi Koki, Co., Ltd., Tokyo, Japan

[21] Appl. No.: 09/245,410

[22] Filed: Feb. 5, 1999

[30] Foreign Application Priority Data

Feb. 6, 1998 [JP] Japan ..... 10-025459

[51] Int. Cl.[6] ..... B41J 5/30

[52] U.S. Cl. ..... 400/61; 400/70; 400/76; 395/111

[58] Field of Search ..... 400/23, 61, 63, 400/70, 76, 615.2, 279, 582, 586, 9, 323; 395/109, 111, 117

[56] References Cited

U.S. PATENT DOCUMENTS 5,551,785 9/1996 Mori et al. ..... 400/76
5,603,578 2/1997 Furuya ..... 400/279
5,795,086 8/1998 Wantanabe et al. ..... 400/615.2
5,819,009 10/1998 Nakagawa ..... 395/117 X

*Primary Examiner*—Edgar Burr
*Assistant Examiner*—Minh H. Chau
*Attorney, Agent, or Firm*—Whitham, Curtis & Whitham

[57] ABSTRACT

A method of forming a high-quality image on an elongated recording medium, such as a roll of paper sheet. When an image includes a character which stretches between two print regions, a blank line portion of the image is detected. When image forming operation is performed for forming a portion of the image up to the blank line, sheet feed operations are performed. Then, image forming operation for a remaining portion of the image is performed. Because the sheet feed operation will not be performed in the middle of printing of such image, undesirable broken line or gap will not be formed on the printed image.

11 Claims, 5 Drawing Sheets

METHOD OF FORMING IMAGE ON ROLL OF PAPER SHEET

BACKGROUND OF THE INVENTION

1. Field of the Invention

The present invention relates to a method of forming an image on a roll of paper sheet as the paper sheet is transported stepwise in a sheet feed direction.

2. Description of the Related Art

There has been proposed an image forming device including a print head for forming an image on a roll of paper sheet. The print head is reciprocally transported across the paper sheet to form one line's worth of image on the paper sheet. In this type of image forming device, the roll of paper sheet is fed by a predetermined amount in a sheet feed direction each time one-line's worth of image is formed.

However, line feed operations for feeding the roll of paper sheet may not be performed precisely. As a result, the image may be formed with undesirable lines and gaps, thereby degrading quality of the image.

There is another type of image forming device which includes a print head reciprocally movable both in a head moving direction and in a sheet feed direction. With this configuration, the print head can form one region's worth of image, that is, a plurality of lines' worth of image, on the paper sheet without performing sheet feed operations. After one region's worth of image is formed, the paper sheet is fed by a predetermined amount. Then, the subsequent one region's worth of image is formed. In this case, it is unnecessary to perform sheet feed operations every time one line's worth of image is formed. That is, the sheet feed operation is performed less often. Therefore, undesirable lines and gaps will be less likely formed on the image.

However, in this case also, such undesirable lines or gaps may not be prevented completely. Specifically, as shown in FIG. 1, when sheet feed operations are not performed precisely, a character image 200 straddling two print regions of a paper sheet may be formed with an undesirable blank line 200*a* or a gap.

SUMMARY OF THE INVENTION

It is an objective of the present invention to overcome the above-described problems, and also to provide an image forming method of forming a high-quality image without undesirable lines or gaps on a recording medium.

It is also an objective of the present invention to provide an image forming device capable of a high-quality image without undesirable lines or gap.

In order to achieve the above and other objectives, there is provide a method of forming an image on a recording medium with an image forming device having a print head. The method includes the steps of (a) reading one print-region's worth of print data, (b) forming an image on a recording medium based on the print data while the recording medium is held stationary, the image being formed by the print head reciprocating a plurality of times in a first direction, and (c) feeding the recording medium by a feed amount in a second direction perpendicular to the first direction, the recording medium having a width in the first direction. The step (b) includes the steps of (d) determining whether or not the image to be formed on the recording medium straddles two print regions, (e) if the image to be formed on the recording medium straddles two print regions, detecting a portion of the one region's worth of print data corresponding to a blank portion of the image where the print head does not print for a line in the first direction, (f) forming a part of the image up to the blank portion, (g) calculating a length in the second direction of the part of the image formed in the step (f), and (h) setting the length as the feed amount.

There is also provided an image forming device including reading means, a print unit, a feed mechanism, determination means, detecting means, and calculation means. The reading means reads one region's worth of print data. The print unit forms an image based on the one region's worth of print data on a recording medium in a print region defined by a start line and an end line while the recording medium is held stationary. The print unit forms the image by reciprocating a plurality of times in a first direction. The recording medium has a width in the first direction. The print region has a length in a second direction perpendicular to the first direction. The feed mechanism feeds the recording medium in the second direction by a feed amount. The determination means determines whether or not the image to be formed straddles two print regions. The detecting means detects a portion of the one region's worth of print data corresponding to a blank portion of the image where the print unit does not print for a line in the first direction when the image to be formed is determined to straddle two print regions. The calculation means calculates a distance between the start line and the blank portion of the image. When the image to be formed is determined to straddle two print regions, the print unit forms a portion of the image up to the blank portion, and the feed mechanism feeds the recording medium by a distance calculated by the calculation means.

BRIEF DESCRIPTION OF THE DRAWINGS

The particular features and advantages of the invention as well as other objects will become more apparent from the following description taken in connection with the accompanying drawings, in which:

FIG. 4(*b*) is another explanatory view of the image forming operation; and

DETAILED DESCRIPTION OF THE PREFERRED EMBODIMENT

A method for forming an image using an image forming device according to a preferred embodiment of the present invention will be described while referring to the accompanying drawings. In the following description, the expressions "front", "left", "right", "above", and "below" are used throughout the description to define the various parts when the image forming device is disposed in an orientation in which it is intended to be used.

First, an image forming device 110 will be described while referring to FIG. 2.

Figure 1:
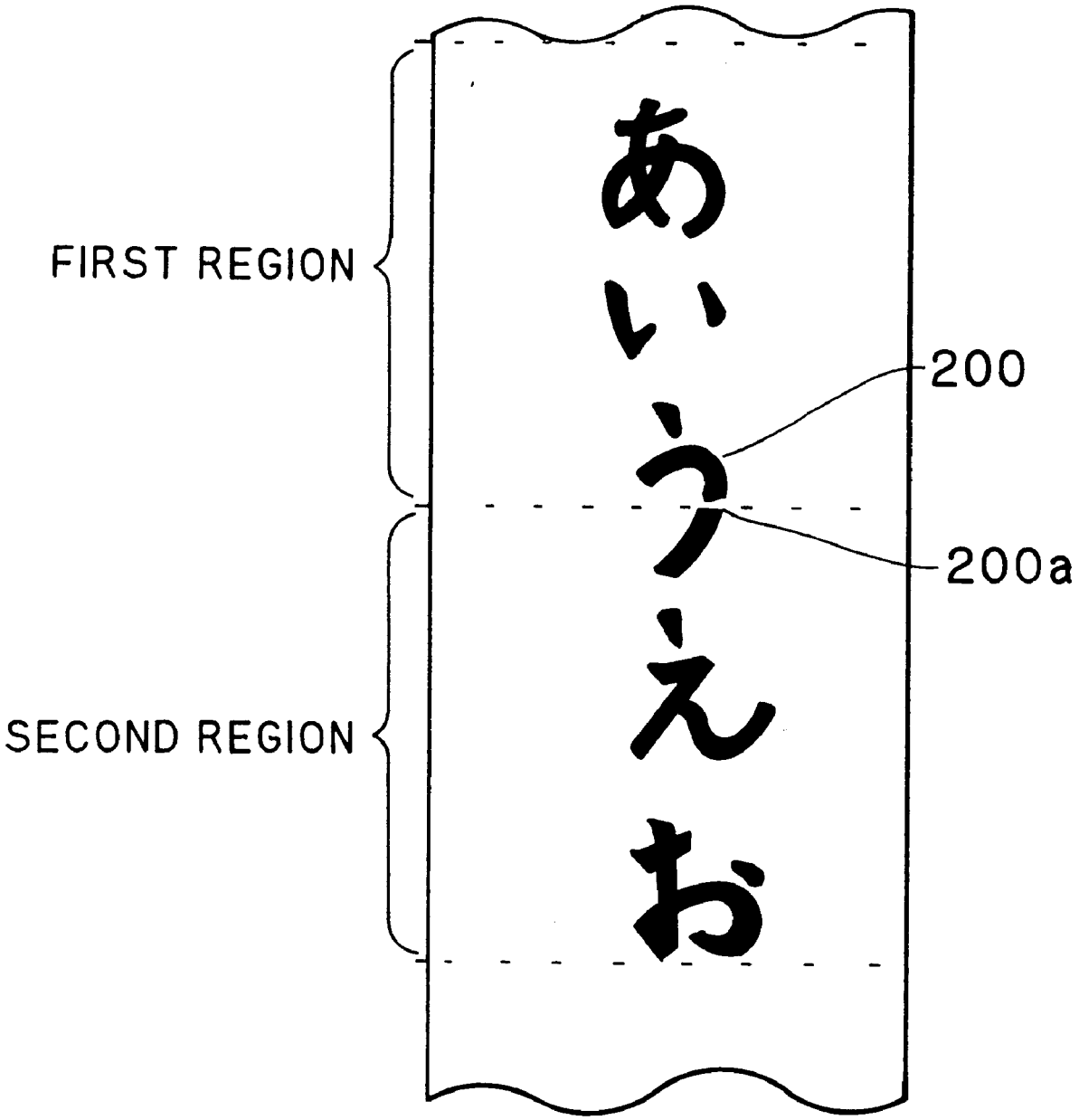
FIG. 1 shows an example of an image formed in a conventional method on a paper sheet.
Figure 2:
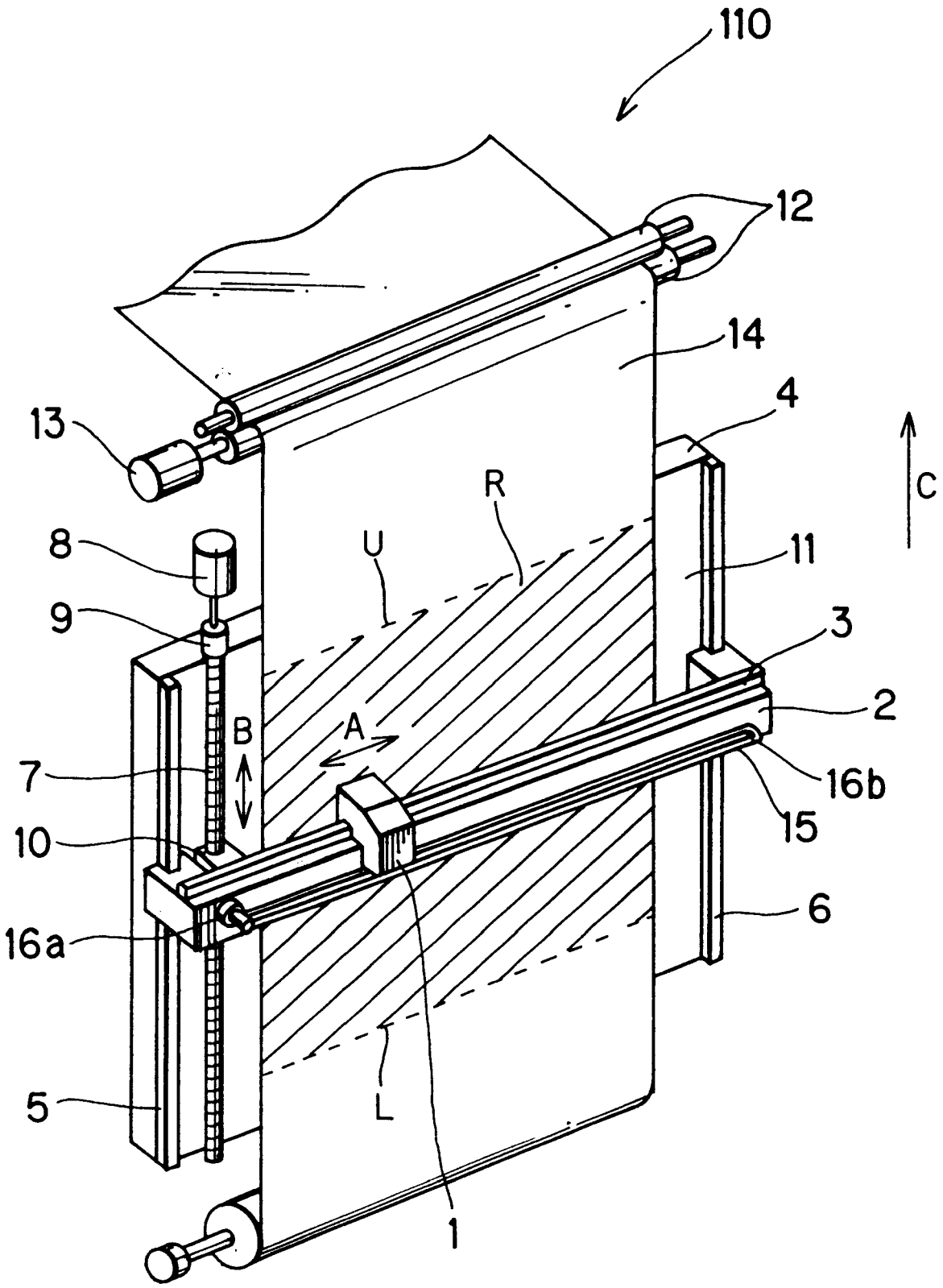
FIG. 2 is a perspective view of an image forming device according to an embodiment of the present invention.
Figure 3:
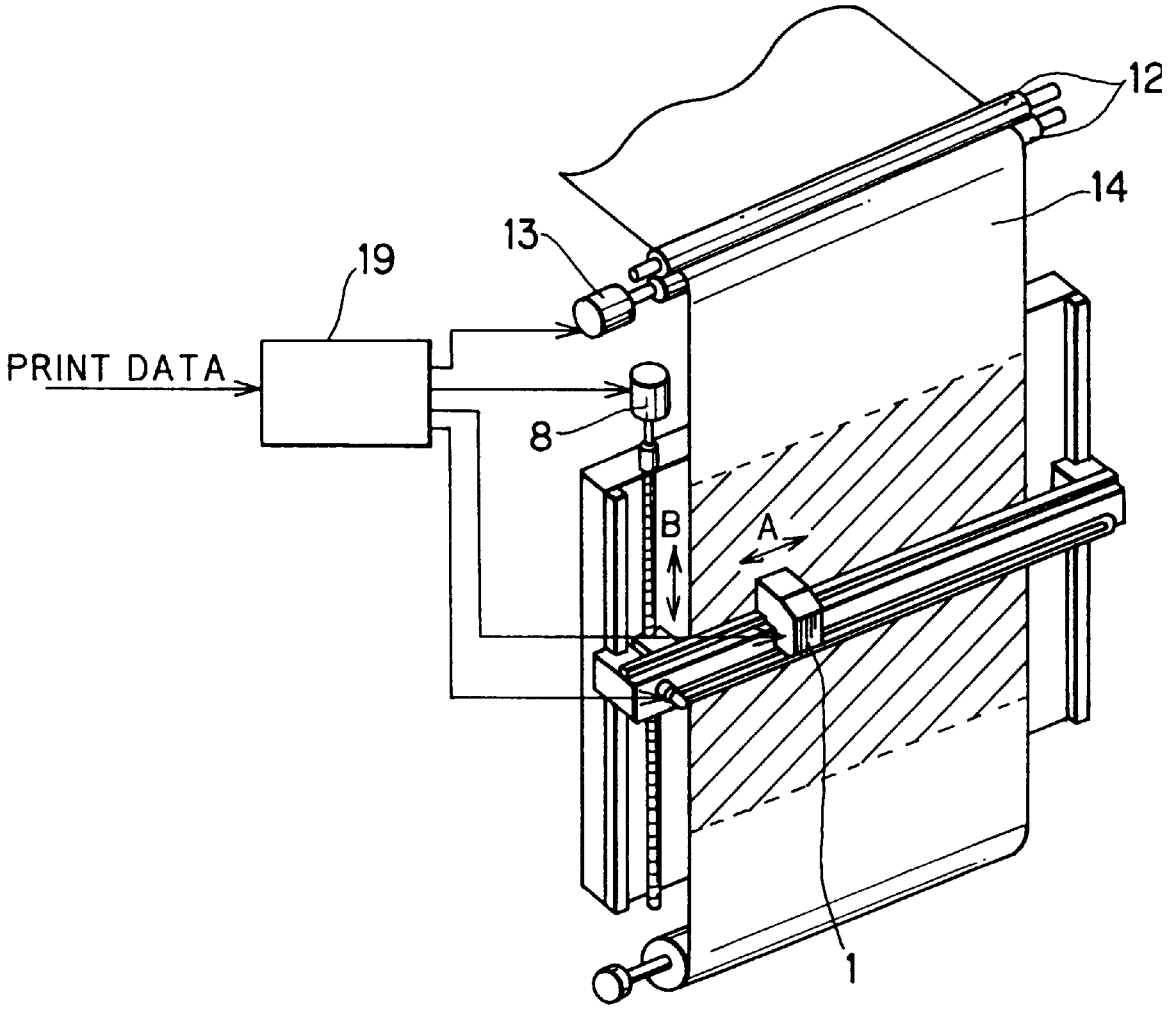
FIG. 3 shows a configuration of a control system of the image forming device of FIG. 2.

As shown in FIG. 2, the image forming device 110 includes a print head 1, an arm 2, a base 4, a pair of guide rails 5, 6, a ball screw 7, a motor 8, a coupling 9, a block 10, a pair of sheet feed rollers 12, a motor 13, and a control unit 19 (FIG. 3).

The base 4 has a front surface 11 and is positioned in an upright posture. The arm 2 extends in right and left directions indicated by an arrow A, and is provided with a guide rail 3. The print head 1 is reciprocally slidably mounted on the arm 2 and the guide rail 3 such that the print head 1 faces the front surface 11 of the base 4 while keeping a predetermined distance from the base 4. The print head 1 is a well-known ink jet print head for forming an image on a recording medium in a conventional manner. The block 10 is attached to the arm 2 and formed with a through hole. The image forming device 110 further includes a reversible motor (not shown), a timing belt 15, a driving pulley 16*a*, and a driven pulley 16*b*. The print head 1 is mechanically connected to the reversible motor via the timing belt 15, so that rotational movement of the reversible motor is transmitted to the print head 1 so as to reciprocally move the print head 1 in the direction A.

The guide rails 5, 6 are attached on the front surface 11 of the base 4 so as to extend in a vertical direction indicated by an arrow B. The ball screw 7 is provided near the guide rail 5 between the guide rails 5, 6, and extends in the vertical direction B. The ball screw 7 is connected at one end to the motor 8 via the coupling 9 so that the motor 8 drives the ball screw 7 to rotate. The ball screw 7 is formed with a spiral groove on its surface and engaged with the through-hole of the block 10. With this configuration, when the ball screw 7 rotates, the block 10 with the arm 2 attached thereto is moved in the vertical direction B.

The sheet feed rollers 12 are provided above the base 4 and connected to the motor 13. The motor 13 drives the sheet feed rollers 12 to rotate. A roll of paper sheet 14 is provided beneath the base 4, and is manually set in the image forming device 110 by a user. Specifically, the user draws a leading portion of the paper sheet 14 between the arm 2 and the front surface 11 of the base 4, and further between the pair of rollers 12. When the motor 13 drives the sheet feed rollers 12 to rotate, the sheet feed rollers 12 feed the paper sheet 14 in a sheet feed direction indicated by an arrow C.

Figure 4A:
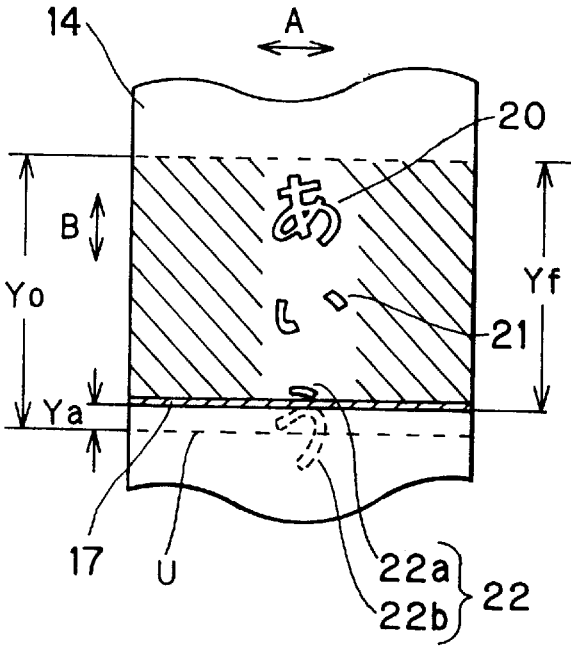
FIG. 4(*a*) is an explanatory view of an image forming operation according to the embodiment of the present invention.
Figure 4B:
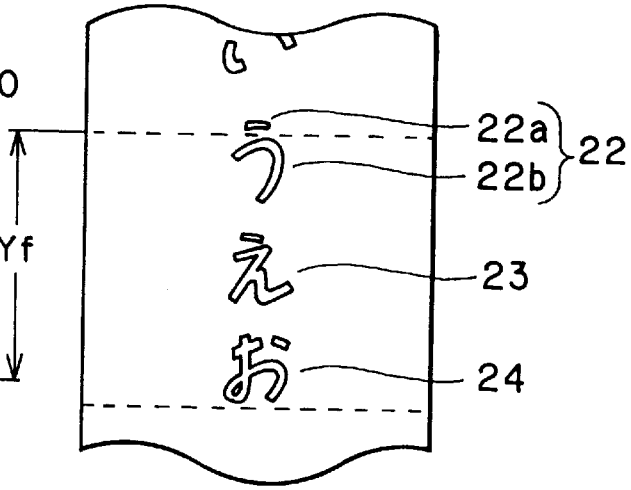

As shown in FIGS. 2 and 4(*a*), the front surface 11 of the base 4 defines a print region R between an upper end U and a lower end L. The print region R has a predetermined length Yo in the vertical direction B.

The control unit 19 shown in FIG. 3 executes overall control of the image forming device 110. Although not shown in the drawings, the control unit 19 includes a well known memory storing various control programs and counters, such as a sheet feed counter. When the control unit 19 receives print data from an external device (not shown), the control unit 19 outputs a drive signal for driving the motors 13, 18, and the print head 1 in a well known manner.

Next, an image forming operation performed in thus configured image forming device 110 will be described. When the image forming operation is started, the print head 1 is moved to the upper left corner of the print region R. That is, the print head 1 is moved to the left side of the arm 2, and the arm 2 is moved to the upper portion of the print region R. At this time, the arm 2 can be maintained at the same location by a supporting force of the motor 8. Then, the print head 1 forms one-line's worth of image while reciprocating one time, that is, moving from the left to the right and coming back to the left. Then, the motor 8 drives the ball screw 7 to rotate, thereby moving the arm 2 downward by a predetermined amount. The print head 1 forms the next one-line's worth of image in the same manner. Then, the same processes are repeated until the arm 2 reaches the lower end L. In this way, one region's worth of image is formed in the print region R on the paper sheet 14. Next, the paper sheet 14 is fed in the sheet feed direction C by the amount of Yo, and the print head 1 is moved back to the upper left corner of the print region R. Then, above-described operations are repeated to form a subsequent portion of the image.

However, when a character included in the image is detected to extend across the lower end L of the print region R, the image is searched for a blank line or space closest to the lower end U. In the example shown in FIGS. 4(*a*) and 4(*b*), an image includes characters 20, 21, 22, 23, and 24, and the character 22 extends across the lower end L. A search for the blank line closest to the lower end U will detect a blank line portion 17 between first and second portions 22*a*, 22*b* of the character 22.

The blank line portion 17 is then set as the lower end L of the current print region R. Also, a distance Ya between the blank line portion 17 and the lower end L is detected for later use.

The print head 1 performs a print operation for forming an image until it reaches the blank line portion 17 as the lower end L. That is, the print head 1 forms characters 20, 21, and the first portion 22*a* of the character 22.

Then, a distance Yf between the upper end U and the blank line portion 17 is calculated using the following formula:

$$Yf=Yo-Ya$$

wherein, Yo is the length of the print region R in the vertical direction B; and Ya is a distance between the blank line portion 17 and the lower end L.

Then, the paper sheet 14 is fed by the distance Yf. Subsequently, as shown in FIG. 4(*b*), the image forming operations are performed for a subsequent one region's worth of image, that is, the second portion 22*b* of the character 22 and the characters 23, 24.

Figure 5:
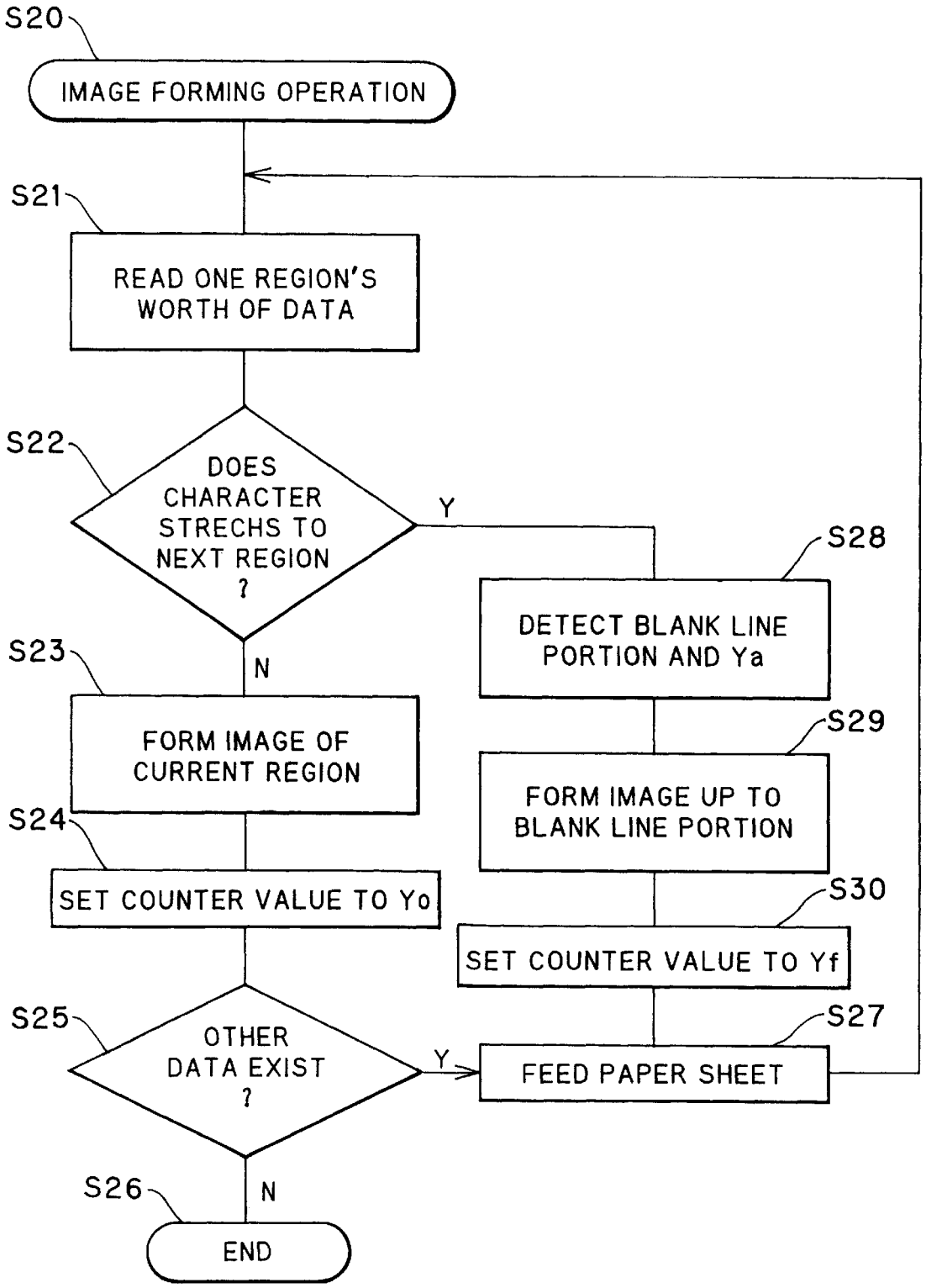
FIG. 5 is a flowchart representing the image forming operation.

Next, the image forming operation will be described while referring to the flowchart shown in FIG. 5. The image forming operation is executed when the control unit 19 receives print data from an external device (not shown). When the operation is started, first in S21, one region's worth of print data is read. Then, it is determined in S22 whether or not an image corresponding to the print data includes a character which extends into a subsequent region. If not (NO:S22), the print operation is performed in S23 for forming an image based on the one region's worth of print data. Then in S24, a value of a sheet feed counter is set to Yo. Next, it is determined in S25 whether or not unformed print data exists. If so (YES:S25), the paper sheet 14 is fed in the sheet feed direction C for the amount of Yo, then, the program returns to S21. If not (NO:S25), the present process is ended.

On the other hand, if S22 results in an affirmative determination (YES:S22), the program proceeds to S28 wherein a blank line portion is detected, and the blank line portion is set as the lower end L of the print region R. Also in S28, a distance Ya is detected. Then, the print operation is performed in S29 for the current region. Next in S30, the value of the sheet feed counter is set to Yf. The paper sheet 14 is fed in S27 in the feed direction C for an amount of Yf, then the program returns to S21 wherein a subsequent one region's worth of print data is read. It should be noted that, at this time, a portion of the print data corresponding to a unformed portion of the image is included in the subsequent one region's worth of print data.

As described above, when a character included in an image stretches across the lower end L of the print region R, a sheet feed operation is performed when the print head 1 reaches a blank line portion closest to the lower end L. Therefore, even if a sheet feed operation is performed imprecisely, there is no danger that quality of a printed image will be adversely effected. Therefore, a high quality image can be reliably provided.

While the invention has been described in detail with reference to a specific embodiment thereof, it would be apparent to those skilled in the art that various changes and modifications may be made therein without departing from the spirit of the invention, the scope of which is defined by the attached claims.

What is claimed is:

1. A method of forming an image on a recording medium with an image forming device having a print head, the method comprising the steps of:

(a) reading one print-region's worth of print data;

(b) forming an image on a recording medium based on the print data while the recording medium is held stationary, the image being formed by the print head reciprocating a plurality of times in a first direction;

(c) feeding the recording medium by a feed amount in a second direction perpendicular to the first direction, the recording medium having a width in the first direction, wherein the step (b) comprises the steps of:

(d) determining whether or not the image to be formed on the recording medium straddles two print regions;

(e) if the image to be formed on the recording medium straddles two print regions, detecting a portion of the one region's worth of print data corresponding to a blank portion of the image where the print head does not print for a line in the first direction;

(f) forming a part of the image up to the blank portion;

(g) calculating a length in the second direction of the part of the image formed in the step (f); and (h) setting the length as the feed amount.

2. The method according to claim 1, wherein in the step (e) when the image to be formed has a plurality of blank portions, a portion of the print data corresponding to one of the plurality of blank portions closest to an end of the current print region is detected.

3. The method according to claim 1, wherein the step (b) further comprises the steps of (i) if the image to be formed does not straddle two print regions, forming the image corresponding to the one print-region's worth of print data, and (j) setting a length of the image in the second direction formed in the step (j) as the feed amount.

4. The method according to claim 1, wherein the steps (a) to (c) are repeated until an image corresponding to entire print data is formed.

5. The method according to claim 4, wherein after the part of the image is formed up to the blank portion in the step (f), then subsequent one region's worth of print data including a portion of print data corresponding to a remaining part of the image is read in the step (a).

6. An image forming device comprising:

reading means for reading one region's worth of print data;

a print unit that forms an image based on the one region's worth of print data on a recording medium in a print region defined by a start line and an end line while the recording medium is held stationary, the print unit forming the image by reciprocating a plurality of times in a first direction, the recording medium having a width in the first direction, the print region having a length in a second direction perpendicular to the first direction;

a feed mechanism that feeds the recording medium in the second direction by a feed amount;

determination means for determining whether or not the image to be formed straddles two print regions;

detecting means for detecting a portion of the one region's worth of print data corresponding to a blank portion of the image where the print unit does not print for a line in the first direction when the image to be formed is determined to straddle two print regions;

calculation means for calculating a distance between the start line and the blank portion of the image, wherein when the image to be formed is determined to straddle two print regions, the print unit forms a portion of the image up to the blank portion, and the feed mechanism feeds the recording medium by a distance calculated by the calculation means.

7. The image forming device according to claim 6, wherein the print unit comprises a mount unit extending in the first direction and movable in the second direction and a head movably mounted on the mount unit, the head forming an image based on the print data by reciprocating a plurality of times in the first direction.

8. The image forming device according to claim 6, wherein the recording medium has an elongated shape.

9. The image forming device according to claim 6, wherein when the image to be formed has a plurality of blank portions, the detecting means detects a portion of the one region's worth of print data corresponding to one of the plurality of blank portions closest to the end line.

10. The image forming device according to claim 6, wherein the first direction is a horizontal direction, and the second direction is a vertical direction.

11. The image forming device according to claim 6, wherein after the feed mechanism feeds the recording medium by the distance calculated by the calculation means, the reading means reads subsequent one region's worth of print data including a portion of the one region's worth of print data corresponding to another portion of the image which has not been formed.

* * * * *